US005512005A

United States Patent [19]

Gulling

[11] Patent Number: 5,512,005

[45] Date of Patent: Apr. 30, 1996

[54] PROCESS AND APPARATUS FOR AUTOMATICALLY ENGRAVING STONE MEMORIAL MARKERS

[75] Inventor: Robert L. Gulling, Bucyrus, Ohio

[73] Assignee: Michael P. Short, Bucyrus, Ohio

[21] Appl. No.: 103,581

[22] Filed: Aug. 9, 1993

Related U.S. Application Data

[63] Continuation of Ser. No. 936,622, Aug. 28, 1992, abandoned.

[51] Int. Cl.[6] ..... B24C 1/00

[52] U.S. Cl. ..... 451/29; 451/30; 451/81; 451/87; 451/89; 451/100

[58] Field of Search ..... 51/310, 319, 323, 51/326, 418, 424, 425, 426; 451/29, 30, 31, 38, 39, 40, 41, 54, 57, 60, 75, 80, 81, 87, 88, 89, 99, 100

[56] References Cited

U.S. PATENT DOCUMENTS

| | | | |
|---|---|---|---|
| 2,617,225 | 11/1952 | O'Brien | 51/310 |
| 4,133,919 | 1/1979 | Parsons | 51/310 |
| 4,897,969 | 2/1990 | Balhorn | 51/310 |
| 5,085,016 | 2/1992 | Rose | 51/429 |
| 5,197,234 | 3/1993 | Gillenwater | 51/319 |

*Primary Examiner*—Maurina T. Rachuba
*Attorney, Agent, or Firm*—Standley & Gilcrest

[57] ABSTRACT

The present invention relates to process and apparatus for automatically engraving stone memorial markers comprised of granite or marble. The markers have their polished facing surfaces covered with a cut-out blast-resistant stencil having prescribed lettering, numerals, decorative patterns and the like. The markers are conveyed through a sand blast chamber at a uniform rate and plural direct-air-feed nozzles are moved uniformly transversely thereover to effect precisely uniform engraving of the facing surfaces. The engraving is more precisely defined to a prescribed uniform depth with finer detail than heretofore possible by manual or other automated single-nozzle methods. The plural nozzles are essentially continuously fed with pressurized air and blast cutting media to obtain faster and more accurate engraving.

31 Claims, 7 Drawing Sheets

Fig. 4
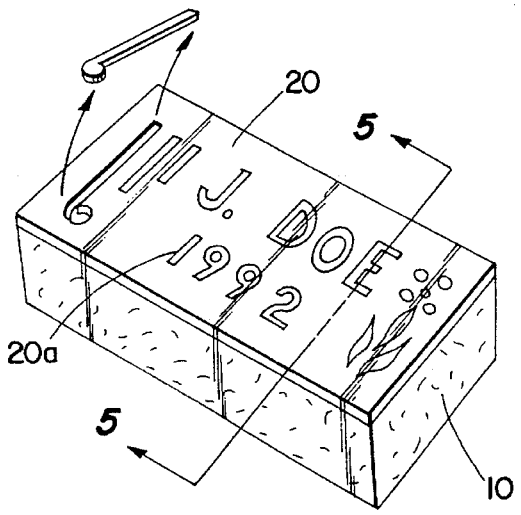
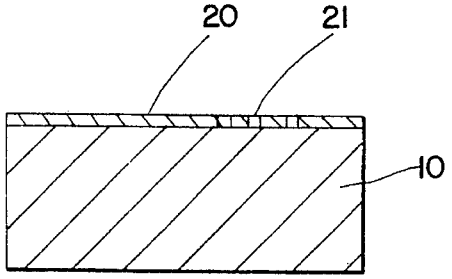
Fig. 5
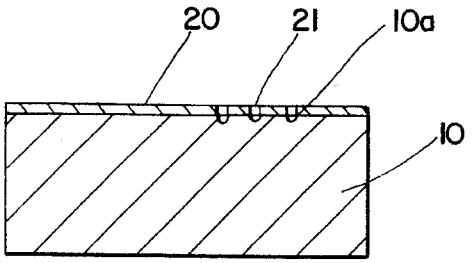
Fig. 6
Fig. 7
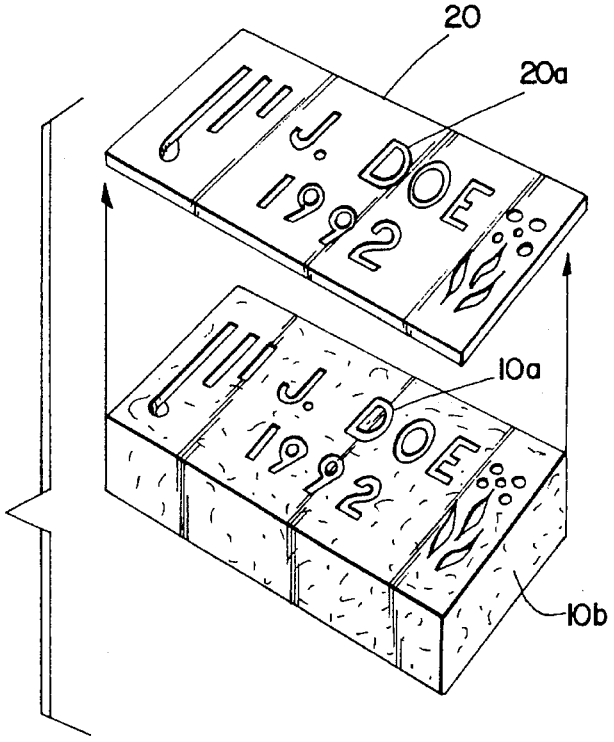

PROCESS AND APPARATUS FOR AUTOMATICALLY ENGRAVING STONE MEMORIAL MARKERS

This application is a continuation of application Ser. No. 07/936,622, filed Aug. 28, 1992, now abandoned.

TECHNICAL FIELD

The present invention relates to process and apparatus for automatic sand blasting of stone memorial markers, tiles, tablets of stone and other materials having a surface to be acted upon by a finely-divided abrasive material blast to provide grooved lettering, decorative indicia, satin or frosted surfaces, and the like.

BACKGROUND INFORMATION

Normally, the surface to be acted upon is covered by a protective stencil made of flexible rubber or plastic which is adhesively attached to the surface to be forcefully sand blasted by the abrasive material. The stencil has a cut-out configuration desired to be acted upon by the forceful blast of abrasive material.

The finely-divided abrasive material blast is produced by a sandblasting jet or jets of pressurized air carrying the abrasive material, directed against the exposed cut-out portions of the stencil-covered surface. The cut-out portions of the stencil are acted upon by the blast to engrave the surfaces therebeneath. The protected surfaces underneath the solid or non-cut-out portions of the stencil are not acted upon by the blast.

Prior art sand blasting processes have previously been performed in a suitable enclosure to receive the workpieces to be acted upon. Such enclosures have commonly had an access opening on one side. Usually a blast-resistant curtain having a horizontal slot is hung over the access opening and is movable vertically with respect to the enclosure. A single sandblast jet is inserted through this slot and moved back and forth horizontally as the curtain is moved vertically. In the majority of such operations the jet is manually operated and the workpiece is mounted vertically.

It has been found that manual operation of the jet by most skillful operators has been unable to produce sandblasting effects of uniform quality or depth of penetration of precise magnitude. Since the jet cannot be manually operated with precisely uniform motion, the workpieces are frequently cut too deeply in some areas and not sufficiently deep in other areas.

In addition, such manual operations are harmful to the operators as the sand, or other harmful substances in the abrasive material, can be inhaled by the operators who in time can and do contract lung diseases.

As stated, various types of automatic sand blasting machines have been developed which include a horizontally-movable carriage and a vertically-movable curtain having a slot-type opening therein, the sand blast jet being located on or through the carriage and projecting through the slot in the curtain. Such machines have inherent difficiencies in the combinations of carriages and curtains to permit the blasting jet to operate therethrough. Also such machines only employ a single jet and are often modified to permit manual or semi-manual operation resulting in inefficient operation. Further, the resulting end products are frequently of poor quality engraving primarily depending on the skill of the operator.

In the case of stone memorial markers, over substantial periods of time, the markers do not wear evenly and the engraved indicia tend to become illegible in the shallower engraved areas. Thus, precisely uniform engraving is highly desirable in high-quality workpieces which can withstand the tests of time in outdoor exposure.

U.S. Pat. No. 3,436,866 to Nye discloses an automatic sandblasting machine in which an upright rectangular frame is mounted parallel to and spaced from the front of the curtain. A horizontally-mounted elongated carriage is vertically movably mounted in the frame and means is provided attaching the carriage to the curtain. The carriage is moved up and down in the frame and the curtain is moved therewith. A second movable carriage is also provided.

In this type of sandblast machine, a single blast jet is employed to move with the curtain and within the curtain slot to direct the single jet against the work surface. The curtain-type machine is impractical in modern-day use wherein the waste products of sand blasting, usually airborne dust, must be fully contained and are not permitted to pass into the atmosphere causing health and contamination problems. In addition, the single jet cannot engrave any substantial surface of a workpiece to a uniform depth of high quality.

U.S. Pat. No. 2,617,225 to O'Brien discloses a method of sandblasting employing a single venturi-type nozzle and not a direct-air-type nozzle of the present invention. The nozzle of this prior art method is manually controlled and cannot provide high-quality engraving of uniform depth.

U. S. Pat. No. 2,450,401 to Thompson also utilizes a single venturi-type nozzle and has the same deficiencies of the other prior art.

SUMMARY OF THE INVENTION

A primary object of the present invention is to provide an automatic sandblast machine and process of engraving stone memorial markers which are highly efficient and can provide precisely uniform engraving having various types of lettering, numerals, decorative patterns, and other indicia of high quality.

Another object of the present invention is to provide method and apparatus for engraving of stone markers and the like which are automatically engraved in series in an enclosed sand blast chamber with both lateral movement of the marker and transverse movement of plural sand blast nozzles, both being precisely controlled by a programmed source to ensure uniform engraving to a prescribed uniform depth with finer detail than heretofore possible.

Another object of the present invention is to provide method and apparatus for stone engraving employing a plurality of direct-air operated nozzles utilized in series of two or more in overlapping relation with respect to the surface to be acted upon, the engraving being precisely and uniformly formed throughout with more precisely defined configurations than obtainable previously.

Still another object of the present invention is to provide highly-efficient method and apparatus for stone engraving of multiple workpieces delivered serially to an enclosed sandblast chamber, the operation being computer-controlled with respect to relative movements of the workpieces and the direct-air-fed nozzles of the apparatus, the operation being carried out with complete capture of the abrasive media and waste products of the blasting with the media being reused in a most efficient and dust-free environment.

In addition, the method and apparatus are essentially fully automated to obtain precisely duplicatable results in stone engraving with a single cyclone-type separating chamber combined with a dual-blast chamber system for recovery of the abrasive media and waste products for reuse of the media on substantially continuous basis. The dual-blast chamber system is designed for alternate pressurizing and depressurizing of two similar loading chambers to provide essentially continuous delivery of a particulate abrasive blast media to the plural blasting nozzles.

The present invention also permits the simultaneous engraving of multiple markers disposed in side-by-side horizontal relation depending upon their relative dimensions for most efficient and time saving operation.

Other objects and advantages of the present invention are the efficient time-saving operation of the apparatus on a substantially continuous basis with relative movements of the workpieces and the unique multiple sand-blast nozzles being precisely controlled eliminating the vagaries and inefficiencies of manual operation.

With the aforesaid objects in mind as well as additional advantages which will be apparent from the following specification, applicant hereby discloses in detail his invention for automatic stone marker engraving which is a substantial advance in the art.

BRIEF DESCRIPTION OF THE DRAWINGS

Several preferred embodiments of the invention, illustrative of the best mode in which the applicant has contemplated applying the principles, are set forth in the following description and shown in the drawings, and are particularly and distinctly pointed out and set forth in the appended claims.

FIG. 4 is a perspective view of an individual memorial marker having a cut-out stencil adhered to its planar surface prior to sand blasting.

FIG. 5 is a fragmentary vertical sectional view taken on the line 5—5 of FIG. 4 prior to sand blasting.

FIG. 6 is a view similar to FIG. 5 after sand blasting.

FIG. 7 is an exploded view of the marker after sand blasting with the cut-out stencil removed from the marker.

Similar numerals refer to similar parts throughout the drawings.

DESCRIPTION OF THE PREFERRED EMBODIMENT

Figure 1:
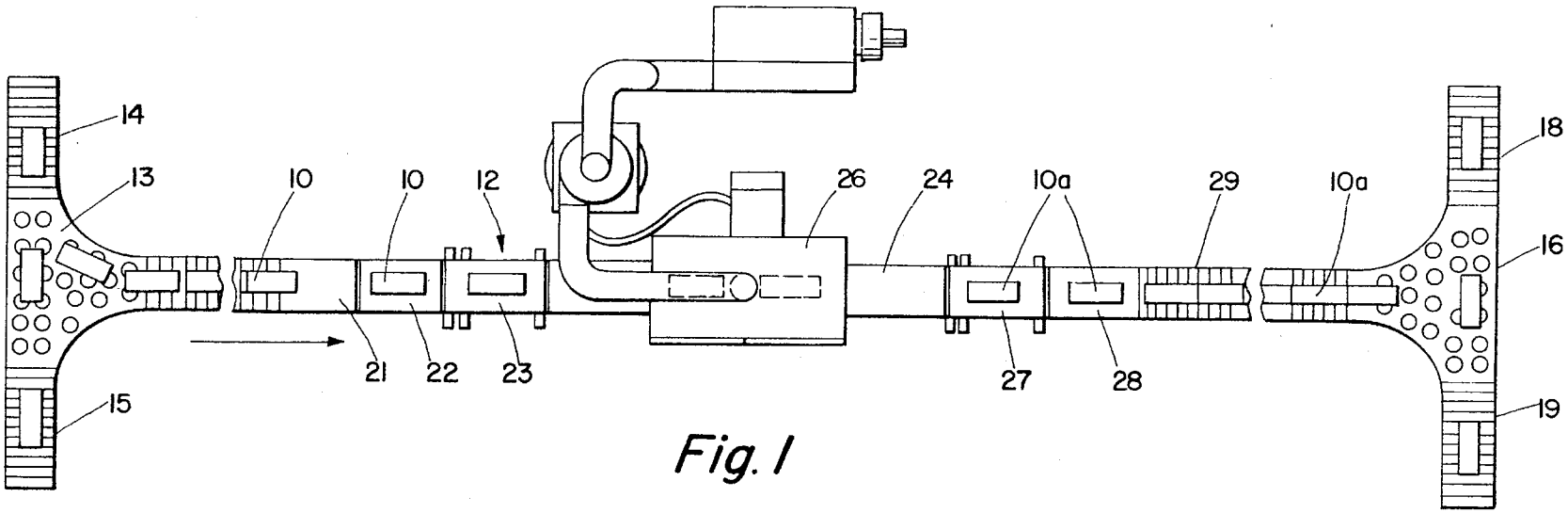
FIG. 1 is top plan view of the sand blasting apparatus and workpieces in accordance with the present invention.
Figure 2:
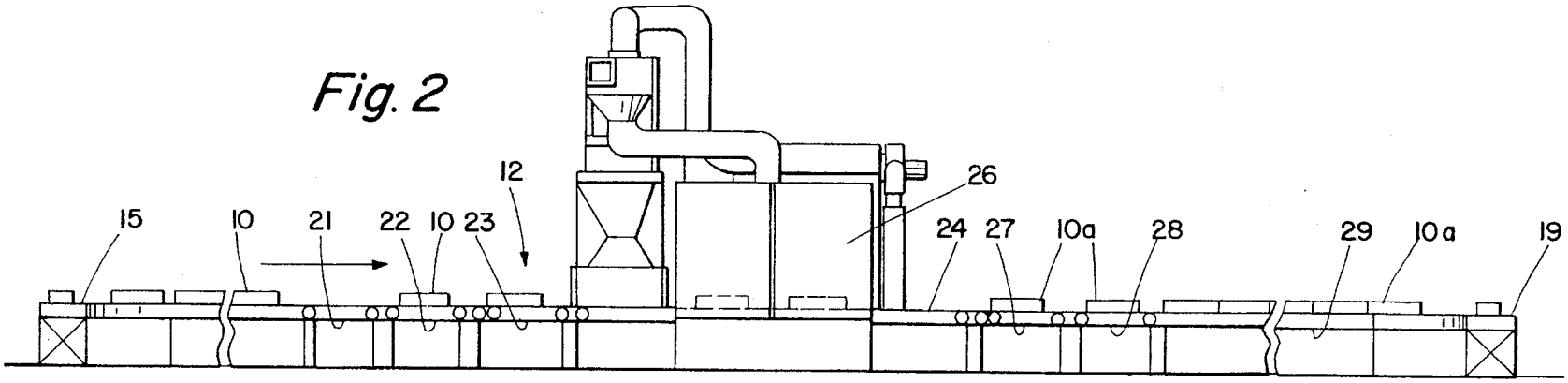
FIG. 2 is a side elevational view of the sand blasting apparatus and workpieces shown in FIG. 1.

In a general description of the overall apparatus for practicing the present invention, the combined apparatus shown in FIGS. 1 and 2 is representative of the preferred combined components for engraving the workpieces, preferably memorial markers. The markers 10 are generally rectangular in shape each having a highly-polished planar surface which is placed on the apparatus facing upwardly in all cases. The markers are comprised of durable solid stone such as granite and marble having roughened side surfaces and dimensions ranging from about 1 to 4 feet in length and about 1 to 2 feet in width, with a thickness of about 4 to 6 inches. The markers 10 shown in FIGS. 1 and 2 have similar dimensions for a single operational campaign of the apparatus.

The apparatus 12 is comprised of a combined series of horizontal conveyors which are located in a generally lineal alignment for moving the markers through the sand blast chamber a on powered conveyor. The prescribed conveyors aligned in end-to-end relation are described hereinafter in greater detail. The apparatus 12 has a pair of side conveyors leading onto an accumulating table at each end to facilitate loading of markers to be engraved and unloading of engraved markers. The accumulating table 13 at the left side of FIG. 1 has a pair of conveyors 14 and 15 disposed perpendicularly to the main lineal conveyor for loading markers to be engraved into a serial end-to-end alignment. The markers have the engraving stencils applied to their facing surfaces while retained on conveyors 14 and/or 15. The accumulating table 16 at the right side of FIG. 1 has a pair of conveyors 18 and 19 disposed perpendicularly to the main conveyor for packaging an$_d$ unloading engraved finished markers for shipping.

A type of conveyors which are particularly useful for conveying the heavy stones are the "Unibolt" conveyors of the Webb-Norfolk Conveyor Division of the J. B. Webb Company. Their equipment is comprised of modular bolted-together lines of belt and gravity roller accumulation conveyor components called "Unibolt" systems. They offer variable speeds to move the work-pieces uniformly at a prescribed rate of travel.

The preparation of the markers for engraving is conducted as follows. As stated, the markers 10 are preformed to the desired dimensions and normally in rectangular shape with the surface to be engraved being highly-polished and planar. Preferred sizes are set forth hereinbelow. Such facing surface is cleaned to receive a cut-out stencil bearing the desired indicia for engraving. The stencil 20 as shown in FIG. 4 has rectangular dimensions to cover the full polished surface of an individual marker 10 and may extend slightly beyond its face-dimensions. Each of the markers 10 has an individual stencil 20 affixed thereto bearing the information and/or decorations to be engraved in the desired pattern.

The stencil material may be varied as desired. A preferred material is Product Style No. 123 blue liner plastic material manufactured and sold by 3-M Co. This stencil is multi-layered having an overall thickness of about 1/16 inch and is very durable, heat-resistant and possesses high wearability features when subjected to sand blasting operations. The stencil has a pressure-sensitive adhesive backing for ready and durable attachment to the marker surface. The indicia patterns 21 may be cut-out of the stencil through its full thickness by computer-controlled apparatus such as the CAD stencil cutting machine. The cut-out portions 21 are removed prior to blasting by manual selection. The preferred stencil mat is a laminated plastic sheet bearing an exterior adhesive backing to provide a stable mat application positioned on the marker throughout the abrasive blasting operation. The stencil mat has favorable characteristics to produce a high quality product having stencil engraved images and indicia which are consistent and uniform throughout the entire marker surface, even in extremely fine detail having circular or irregular dimensions as small as 1/16 inch.

Stencil Style No. 123 is designed for machine cutting with less wear of the cutting dies. This material offers excellent blast resistance and readily-recognizable blue liner. The plastic sheet laminated to the stencil eliminates taping during panel transfer to stone, yet allows easy blast-through and fast clean-up.

The lead-in area of the apparatus carries the markers 10 bearing their adhered stencils 20 over the facing surface of each marker. The loading area 13 of the apparatus from conveyors 14 and 15 has a plurality of freely-rotatable close-spaced rollers to permit gravity loading or manual pushing of the markers into aligned end-to-end relation in an essentially straight-line operational pattern. The markers may be aligned side-by-side when permitted by lesser lateral dimensions which will fit within the side rails of the plural conveyors or singly when wider to preclude such alignment. The markers have sizes such as follows to meet all standardized requirements of such markers including those of governmental agencies:

MEMORIAL MARKER SIZES (in inches)

5"×10"×13"
4½"×12"×24"
4½"×15"×40"
4½"×12"×48"
4½"×22"×48"

ENGRAVING APPARATUS

FIGS. 1 and 2 show in considerable detail a preferred arrangement of interconnecting horizontal conveyors for automatic handling of the markers as they are moved through the engraving process. As stated, the stencil-bearing markers 10 are moved sequentially from the loading table 13 either by gravity or manually into adjacent end-to-end alignment onto a series of powered conveyors designated by the numeral 12. The markers are aligned such as by suitable side rails and preferably moved horizontally by a series of three 5-foot sections of first-powered conveyors designated by the numerals 21, 22 and 23. The powered conveyors connect to an elongated power belt of another powered conveyor 24 of comparable width which extends through the sand blast chamber 26 and beyond both ends thereof. The engraving is performed by direct air blasting within the enclosed sand blast chamber 26 as set forth below under process conditions. The discharge end of the elongated power belt connects with two or more shorter power belts of conveyors 27 and 28 which carry the engraved markers from the blast chamber. The said shorter power belts connect with another gravity conveyor 29 which has freely-rotatable rollers to carry the markers to the existing accumulating table 16 and to the two juxtaposed inspection and packaging conveyors 18 and 19 disposed perpendicularly to the main line of conveyors. The powered belts of the aligned conveyors are arranged to move in synchronism at the desired operating speed to automatically convey the markers through the engraving operation. During any given campaign of the process, the apparatus controls are set to operate with optimum efficiency for a continuous operation. The powered conveyors may be varied in speed and operated collectively in unison for a given sand blasting operation. Thus, the markers are delivered serially on a continuous basis to the blast chamber 26, the markers each having their own individual information and decorations to be engraved. The powered conveyors may be of similar or dissimilar construction, however, it if preferred that they be operable in synchronism such as by a computer-controlled programmed source so that the markers can be transported at a prescribed uniform rate of speed throughout their lineal movement, and especially through the sand blast chamber 26. Obviously, other types of stencil materials may be used for the marker facing stencil for the blasting operation; preferably ones which are wear, heat and blast resistant to only permit engraving in the cut-out portions 21. FIG. 5 shows in a vertical sectional view a marker 10 having the cut-out stencil 20 affixed to its face, the cut-out portions being designated by the numeral 21. FIG. 6 shows in a similar view the marker after sand blasting with the engraved indicia **10*a* cut into the stone face by the forceful blasting operation. FIG. 7 is a perspective view of the marker 10*b* with the stencil removed, and the desired indicia 10*a*** cut into the stone face to the desired depth.

SAND BLAST CHAMBER

Figure 8:
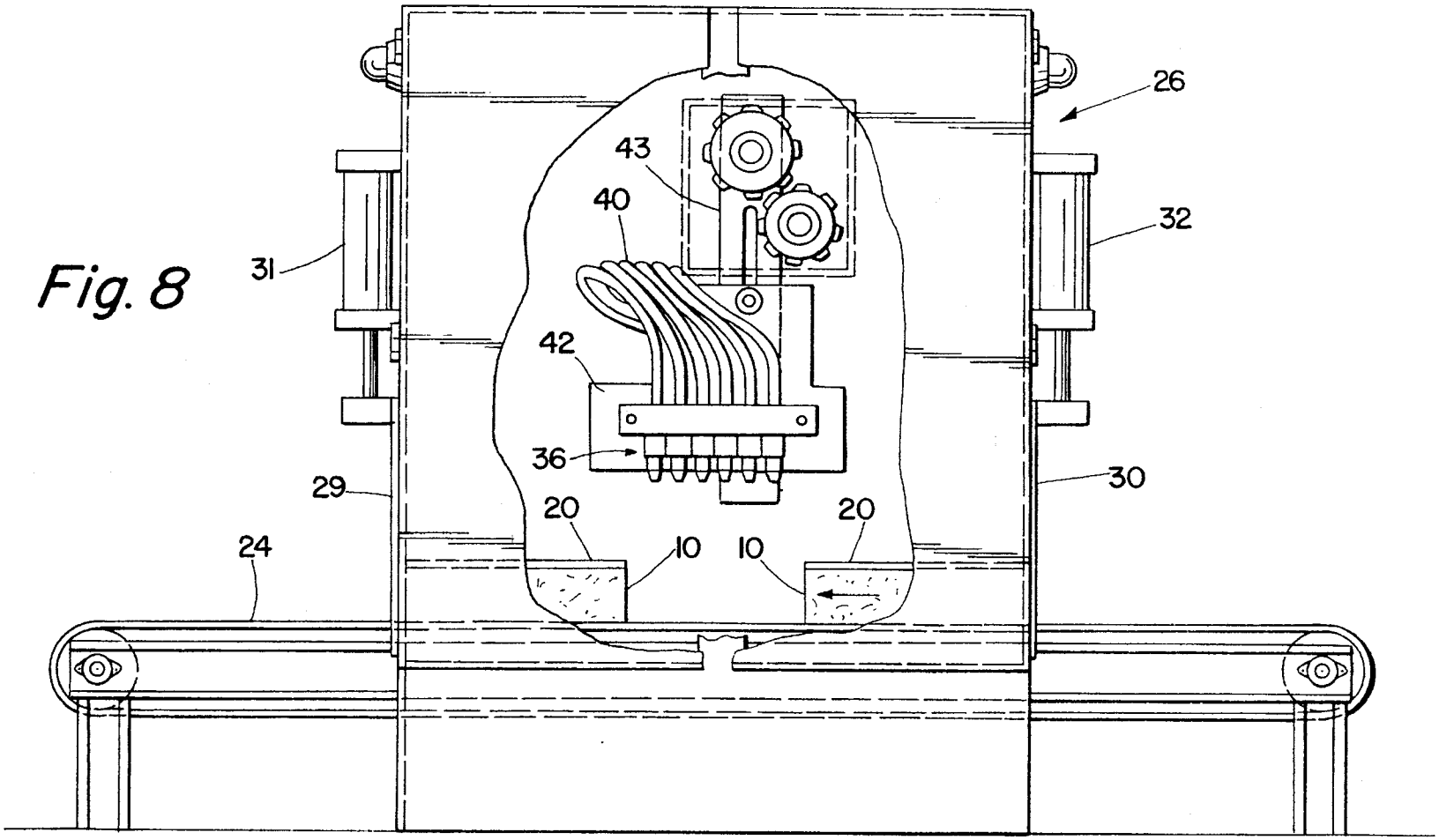
FIG. 8 is an enlarged front elevational view of the enclosed sand blasting chamber of the apparatus shown in FIGS. 1 and 2.

The main lineal power belt 24 extends through the sand blast chamber 26 and beyond both sides thereof to carry the markers therethrough for engraving. The chamber 26 is rectangularly shaped and fully enclosed having vertically-movable doors 29 and 30 at each end extending over the power belt 24, both being capable of sealing thereto when the doors are closed. The doors are capable of power-assisted opening and closing in synchronism to permit entry and exiting of the markers. FIGS. 1 and 2 show the relative location of the blast chamber in a medial region of the power belt 24. The blast chamber is fully sealed when its juxtaposed doors are closed and may vary from about 3 to 12 feet in overall size. FIG. 8 shows in a front view the chamber 26 with the markers being conveyed from right-to-left. The various components for delivery of the abrasive media to the plural nozzles 36 of the blasting chamber, and collection and separation of the waste products of the blasting are also shown in FIGS. 1 and 2. FIG. 8 shows in greater detail a pair of hydraulic cylinders 31 and 32 having attached piston rods which are employed to raise and lower the entry and exit doors of the chamber.

Figure 11:
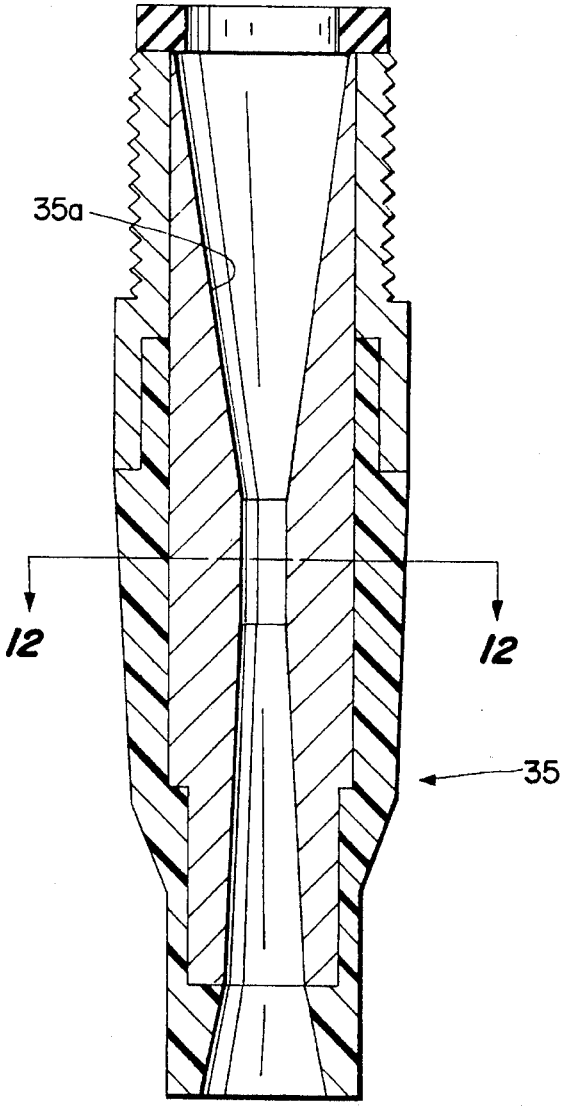
FIG. 11 is a further enlarged vertical sectional view of a direct-air fed nozzle for use in the sand blast apparatus of the present invention.
Figure 12:
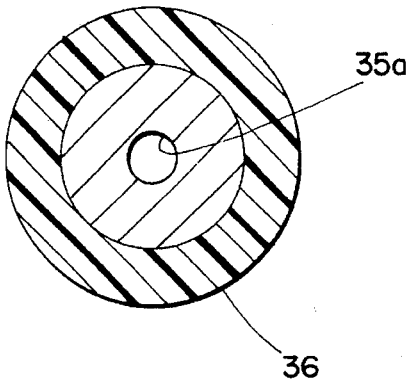
FIG. 12 is a horizontal Sectional view of the nozzle taken along the line 12—12 of FIG. 11.

A plural series of direct-air feed blasting nozzles 36 is mounted over the markers as they are carried on power belt 24 through the blasting chamber. The total number of nozzles is preferably six (6) mounted adjacent to each other in lineal alignment parallel to the direction of travel of the markers. The nozzles are all similar in construction being direct-air-feed type rather than venturi type having substantially straight open passages therethrough as shown in FIGS. 11 and 12 for improved sand blasting. The nozzles are preferably operated in series of 2 to 6 depending upon the desired engraving depth required for a given size, lettering and numerals. The nozzles have a blasting media pattern overlap ranging from about 1 to 2 inches depending upon the spray patterns desired. The multiple nozzles provide a greater cutting action on the markers than where a single nozzle is employed. The nozzles are capable of delivering about 1½ pounds of media per square inch where 5/16 inch nozzles are utilized. Such nozzles have a delivery angle of about 13° 40", the plural nozzles providing about 6 times coverage over the spray area. Thus, for the smaller letters and numerals requiring lesser engraving depth about 2 to 4 nozzles are operated together in synchronism, while for the larger letters and numerals requiring deeper engraving depth, the maximum number of about 5 to 6 nozzles is operated together for optimum efficiency. The individual nozzles have separate operating valves (not shown) which are operated individually, and are turned on or off as programmed as required for the given depth of engraving desired. The nozzles are mounted with their delivery ends positioned about 10½ inches from the stencil-carrying upper surfaces of the markers and at right-angles thereto. The precise distance from nozzle ends to the workpiece surface can be varied as required.

Figure 10:
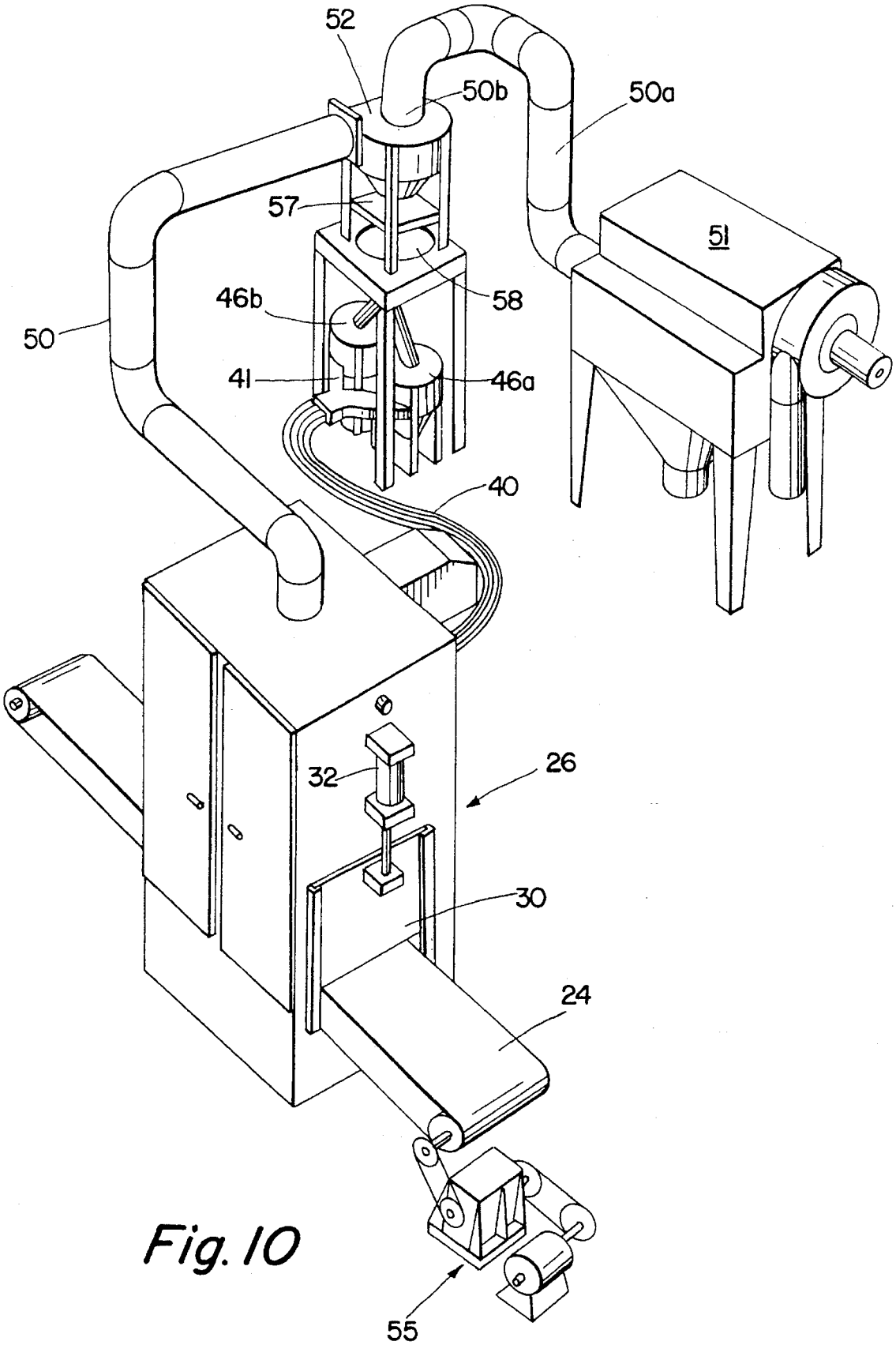
FIG. 10 is a perspective view of the sand blasting chamber shown in FIGS. 8 and 9 and the associated apparatus for collecting, separating and reusing the abrasive media.

The nozzles are each connected to pressurized air lines 40 as shown in FIG. 10 which carry the prescribed amount of abrasive media along with the pressurized air which varies from about 70 to 100 psi. The air lines extend from the inlet ends of the nozzles to a manifold 41 as shown in FIG. 10, the individual lines being grouped together and extending in a collective bundle of durable blast resistant hoses. The grouped nozzles within the blast chamber 26 comprise a unique multi-head air blasting nozzle assembly which can be adjusted vertically within the chamber to provide proper vertical spacing from nozzle delivery ends to the workpiece upper surface. The air lines 40 which terminate at the manifold 41 have individual on-off valves thereat to permit individual operation of each of the nozzles as required, normally in a series of two or more. The nozzles are fixedly mounted on a common movable carriage 42 for proper vertical positioning. The carriage can be raised and lowered as desired on mounting column 43 as shown in FIG. 8. The nozzles are direct pressure nozzles mounted on a horizontal traverse mechanism preferably having 12 cycle strokes per minute.

The blasting chamber has been referred to as a sand-blast chamber, although sand and other abrasive media may be used as the cutting instrumentality. The fully-enclosed blast chamber permits recovery of dust and air-borne particles from the blasting operation. Also the chamber is insulated both interiorly and exteriorly for noise reduction to be substantially sound-proofed when in operation.

SAND BLAST MEDIA

The blast media may be varied as required, from 36 to 60 mesh Alox material being particularly useful for the engraving. Alox 36 U.S. mesh with a working mix of reclaimed finer particles of 36 mesh media is desirable to obtain faster cutting rates. The engraving using air pressure of 80 psi has provided consistent depth of penetration among all like characters of a given stencil pattern. Air and media are held in at least one pressurized loading chamber and are dispensed to the direct-air blast nozzles 36 through individual supply lines 40. The present process provides automatic substantially continuous operation using a mat-type stencil and direct-air nozzles for fine engraving of high quality. In the aforesaid operation using the 36 U,S. mesh Alox a series of 5 nozzles were used at the sand blasting station employing a belt speed of 6 inches per minute and at a nozzle oscillation rate of 12 cycles per minute. Alox is a trade name for finely-divided alumina ($Al_{2O3}$) manufactured by a number of manufacturers. Obviously other types of blast media such as fine sand may be used in the blast engraving.

Figure 9:
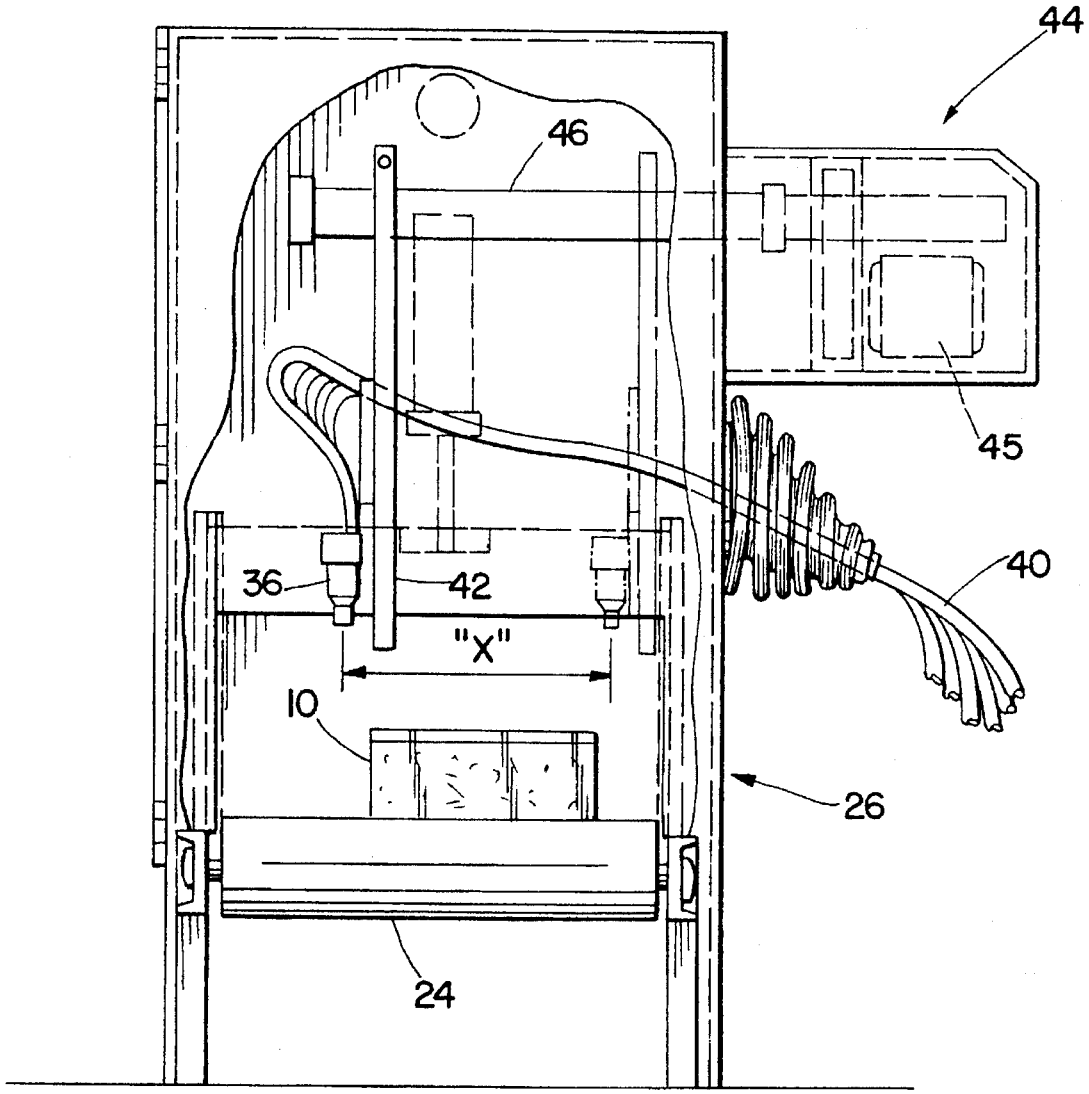
FIG. 9 is an enlarged end view of the enclosed sand blasting chamber shown in FIG. 8.

The plural hoses 40 leading to the nozzles 36 are grouped together as shown in FIGS. 8 and 9, the latter showing the traversing mechanism 44 powered by an electric motor 45 which moves the nozzles attached to horizontal slide bar 46 through their horizontal stroke. The stroke may be varied as desired but must be maintained at a uniform rate of travel while the markers are simultaneously moved. FIG. 9 shows the length of travel of the nozzles designated by the letter "X" for one pass of the nozzles.

FIG. 10 shows in a perspective view the overall apparatus leading to and from blast chamber 26. The air line hoses 40 extend from the chamber 26 to a pair of blast storage chambers 46 mounted in side-by-side relation preferably in upright horizontal relation. The chambers 46 are used to store reclaimed blast media recovered from the blasting operation. The chambers 46 are each connected to a switching valve (not shown) which is capable of pressurizing each of the chambers individually when the media is being delivered into the media carrying pressurized hoses and depressurizing each chamber when the media is being loaded therein from the media recovery system.

The media recovery and reuse system as shown in FIG. 10 utilizes a vacuum line 50 extending from an upper region of blast chamber 26 to a vacuum generating mechanism 51 powered by an electric motor. The vacuum line 50 has a cyclone type separation chamber 52 located in an intermediate area for separation of the waste products generated by the blasting operation. The used media, particles of stone and eroded particles of the stencil are collected by vacuum from the sealed blast chamber and conveyed by negative pressure as dust and debris particles into separation chamber 52. Such unit effects a centrifugal force on the collected particles for their separation into individual fractions primarily by density. The reclaimed media flows downwardly by gravity into a holding bin 58 and thereafter into the depressurized blast chamber during the engraving cycle at which time the pressurized blast chamber is actively supplying direct air and media to sand blast chamber 26. As stated, these chambers are alternately pressurized and depressurized to permit delivery of the air and media into the blast hoses 40 when pressurized and to permit accumulative storage of the media in the other chamber when depressurized. The collection of virtually all by-products of the blasting operation provides a dust-free environment around the blast chamber and one which meets all requirements of environmental protection agencies and their regulations. The waste products from the operation are collected at the filter basket 57 and at the vacuum generating mechanism 51 for suitable disposal. Reused finer particles of 36 mesh Alox are obtained through adjustment downwardly of vacuum line **50*b* inside of cyclone chamber 52. FIG. 10 shows in simplified detail a power source 55 for powered movement of the conveyor 24 through the blast chamber. FIGS. 11 and 12 show the twin-tapered straight line opening 35*a* through an individual nozzle 35** for forceful delivery of the media and pressurized air for the engraving.

PROCESS DETAILS

The present invention employs a plurality of direct-air fed nozzles in a multi-head nozzle assembly. The preferred six-head assembly is designed to switch air and media feed between two similar blast machines for loading the media and air combinedly to the individual delivery hoses and their nozzles. The first pressurized blast chamber **46*a* becomes the active unit through a special selector switching valve which at the same time blocks air/media flow at the discharge point of the second blast chamber 46*b*** which is then inactive and depressurized for media loading. The change from active and inactive blast machines or chambers takes place during the unloading of finished memorial stones or markers and loading of stones or markers to be engraved.

The single cyclone reclaim component of the apparatus is used to deliver reclaimed media to the twin blast machines having dual storage chambers on an alternating basis. The nozzles are then kept ready for substantially continuous automatic blasting without undue delay.

The present process employs a programmable controller (PC) program for controlling the combined apparatus. The PC unit contains a memory bank to automatically initiate operation and control the various steps of the process for most efficient quality and quantity of production. The program selects the requisite number of active air nozzles required to produce the engraved character depth specification for a given marker or markers. The program initiates and controls (1) the beginning and end of each production cycle (2) the marker unloading and loading phases of the operation, and (3) the beginning of each subsequent operating cycle. In addition, the program controls the safety warning indicators just prior to automatically opening and closing the exit and entrance doors of the blast chamber. In essence, virtually all phases of the process operation are automatically controlled for most efficient and optimum production.

Figure 3:
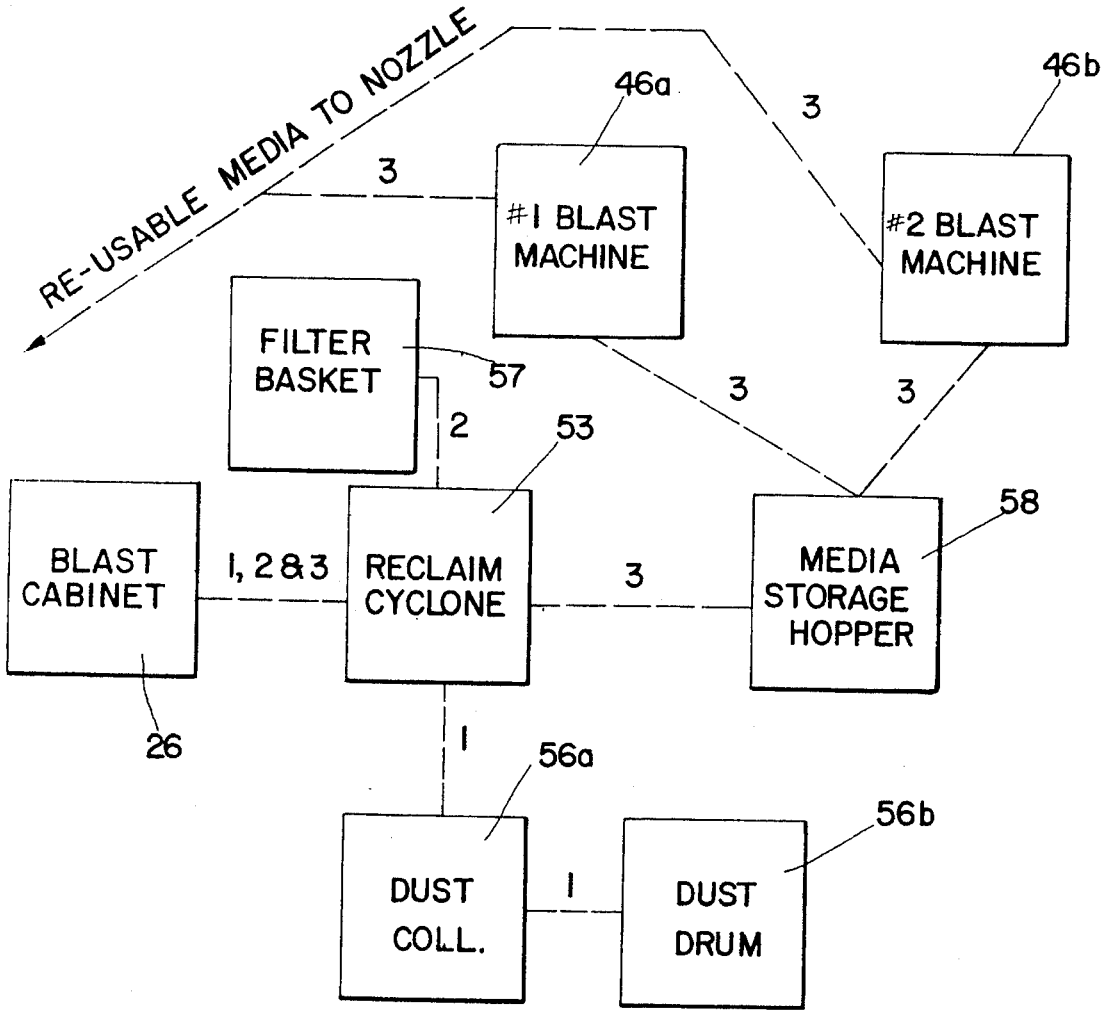
FIG. 3 is a schematic view in the form of a block diagram of the collection, separation and reuse of the abrasive media used in the apparatus of FIGS. 1 and 2.

FIG. 3 shows in a schematic flow diagram, how the dust collected in blast chamber 26 is transported by vacuum to the reclaim cyclone chamber 52, such transport to various areas being designated by the numerals 1, 2 and 3. The cyclone separates the dust waste products, the finest material passing into a dust collector 56*a* and a dust drum 56*b*, designated by the number 1 and the oversize debris passing into a filter basket 57 designated by the numeral 2. The reclaimed blast media is passed into a media storage hopper 58 designated by the numeral 3. The media from the storage hopper 58 is alternately loaded into either No. 1 blast machine 46*a* or No. 2 blast machine 46*b*, such passage being designated by the numerals 3. The re-usable media is then delivered to the nozzles 36 as aforesaid, also designated by the numerals 3. The collected fine dust and oversized filtered material are properly disposed of at intervals, while the media is re-used in an essentially closed cycle.

Various modifications may be resorted to within the spirit and scope of the appended claims.

I claim:

1. The process of automatically engraving a plurality of stone memorial markers in series, each said stone memorial marker having a smooth planar facing surface, said process comprising the steps of:

(a) obtaining an enclosed sand-blast chamber containing a sand-blast zone and containing an array of linearly aligned, direct-air-operated sand blast nozzles directed toward said sand-blast zone, said array of nozzles aligned so as to produce overlapping spray patterns;

(b) advancing said stone memorial markers in series through said sand-blast zone, each of said stone markers having a flexible plastic stencil in adhered relation on its respective said planar facing surface, said stencil being formed of sand-blast-resistant material and having cutout portions in a prescribed pattern of indicia to be engraved on said respective marker; and (c) oscillating said array of nozzles transversely to said path of said markers, while simultaneously continuously controlling and coordinating advancement of said stone markers through said sand-blast zone and the oscillation of said array of nozzles back and forth over said markers, whereby said indicia are engraved on said facing surfaces of said markers to a prescribed uniform depth of penetration.

2. The process in accordance with claim 1 further comprising the step of simultaneously continuously controlling and coordinating, with said advancement of said markers and said oscillation of said array of nozzles, the operation of said nozzles individually.

3. The process in accordance with claim 2, including the step of individually operating a prescribed number of two or more of said nozzles to deliver a direct-air blast of abrasive media against said stencil to form said engraved indicia in said marker having a uniform depth and precise definition comparable to said cut-out portions.

4. The process in accordance with claim 1, including the step of moving said marker in a lineal direction and said array of nozzles transversely thereto at prescribed rates of travel which are controllably operated in synchronism by a programmed source.

5. The process in accordance with claim 1, including the step of employing direct-air blast nozzles powered by pressurized air ranging from about 70 to 100 psi to deliver an abrasive media against said stencil and said facing surface of said marker.

6. The process in accordance with claim 1, including the step of moving said marker horizontally at a uniform rate ranging from about 2 to 18 inches per minute.

7. The process in accordance with claim 1, including the step of engraving said indicia with precise definition in accordance with that of said cut-out portions of said stencil into said facing surface of said marker to a uniform depth ranging from about 1/16 to 5/16 inches.

8. The process in accordance with claim 1, wherein said array of nozzles comprises a series of Standard No. 5 direct-air nozzles having an orifice opening of about 5/16 inch and air pressure ranging from about 70 to 100 psi.

9. The process in accordance with claim 1, including the step of mounting said marker on a lineal conveyor, said planar surface of said marker facing upwardly for its precisely uniform transport through said enclosed sand blast chamber, said chamber containing a sand blast zone of about 3 to 12 feet.

10. The process in accordance with claim 1, including the step of mounting said array of nozzles vertically above said facing surface of said marker at a distance of about 10 ½ inches.

11. The process in accordance with claim 1, wherein said oscillation of said array of nozzles is done so as to overlap the area of said sand blasting of said marker by a distance of about 1 to 2 inches.

12. The process in accordance with claim 1, including the step of oscillating the said array of nozzles over said marker at a rate of about 8 to 16 cycles per minute.

13. The process in accordance with claim 1, including the step of engraving varied intricate patterns in said marker including circular or irregularly-shaped areas as small as 1/16 inch diameter.

14. The process in accordance with claim 1, including the step of employing a lesser number of nozzles operated in synchronism to engrave the marker facing surface to a lesser uniform depth, the range of depth ranging from about 1/16 to 5/16 inch.

15. The process in accordance with claim 1, including the step of maintaining said marker at essentially uniform atmospheric temperature prior to its introduction into said sand-blast chamber.

16. The process in accordance with claim 1, including the steps of collecting the waste products of the sand-blasting operation within said sand-blast chamber and separating the said sand blast media from said waste products exteriorly of said sand blast chamber in a single cyclone-type separating chamber combined with dual blast media storing chambers and reusing the said blast media in a substantially continuous process.

17. The process of engraving stone memorial markers having a smooth planar facing surface for engraving the same in series on an essentially continuous basis, said process comprising the steps of mounting a flexible plastic stencil in adhered relation on said planar facing surface of each marker, said stencil being formed of sand-blast-resistant material and having cut-out portions in the pattern of indicia to be engraved on said marker, mounting a plurality of sand-blast nozzles in lineal spaced-apart adjacent alignment over the said marker contained within an enclosed sand-blast chamber, continuously moving said marker at a uniform rate of advancement through said sand-blast chamber, oscillating said plurality of nozzles back and forth over said marker in overlapping relation while delivering pressurized air and sand-blast abrasive media against said marker to engrave the said indicia on the facing surface of said marker to a prescribed uniform depth, said nozzles being oscillated in overlapping relation transversely to the direction of travel of said marker, collecting the said waste products from the sand blasting operation adjacent to said enclosed sand-blast chamber, and separating the said waste products to recover the said abrasive sand blast media for reuse on a substantially continuous feeding basis.

18. The process in accordance with claim 17, including the step of separating the said waste products and said blast media in a single cyclone-type separation chamber connected to dual blast media storage chambers to permit automatic loading of the blast media alternately from the dual storage chambers to feed said blast nozzles on a substantially continuous basis.

19. Combined apparatus for automatically engraving indicia on stone memorial markers having a smooth planar facing surface, said apparatus comprising:

(a) a flexible plastic stencil adapted to be adhered to said planar facing surface of each marker, said stencil being formed of sand-blast-resistant material and having cut-out portions in a prescribed pattern of indicia to be engraved on said planar facing surface of each marker;

(b) means defining an enclosed sand-blast chamber;

(c) means for supporting and continuously conveying said markers along a path at a uniform rate of advancement through said sand-blast chamber;

(d) a plurality of direct-air-operated sand-blast nozzles mounted in lineal spaced-apart adjacent alignment in said sand-blast chamber;

(e) means supporting said sand-blast nozzles a spaced distance from said planar facing surfaces of said markers and oscillating said nozzles back and forth over said markers transversely to the path of said markers, said nozzles being in overlapping relation with respect to said planar facing surfaces;

(f) means for driving said supporting and conveying means for said markers and said supporting and oscillating means for said nozzles; and (g) programmed control means connected to said driving means to control in synchronism with the rate of movement of said markers along said path by said supporting and conveying means and the rate of oscillation of said nozzles by said supporting and oscillating means to engrave said indicia on said facing surfaces of said markers to a prescribed uniform quality or depth of penetration of precise magnitude.

20. Combined apparatus as defined by claim 19, including a plurality of direct-air blast nozzles ranging in number from about 2 to 6, and means for operating said nozzles in synchronism of two or more to engrave said marker.

21. Combined apparatus as defined by claim 19, including means for delivering an abrasive media and pressurized air ranging from about 70 to 100 psi to each of said nozzles to engrave the facing surface of said marker.

22. Combined apparatus as defined by claim 19, wherein said plurality of nozzles comprises direct-air nozzles having an orifice opening of about 5/16 inch, and means for delivering pressurized air to each of said nozzles at an air pressure ranging from about 70 to 100 psi.

23. Combined apparatus as defined by claim 19, wherein said sand-blast chamber ranges in dimension from about 3 to 12 feet and said nozzles are mounted vertically over said marker at a distance of about 10 ½ inches.

24. Combined apparatus as defined by claim 19, wherein said means for continuously moving said marker through said sand-blast chamber and said oscillating means for moving said plurality of nozzles transversely to said marker are operated in synchronism, the latter at a rate of about 8 to 16 cycles per minute and the former at a rate of about 2 to 18 inches per minute.

25. Combined apparatus as defined by claim 19, wherein said plastic stencil has both large and small indicia, the latter being as small as having about 1/16 inch diameter for precise uniform engraving of said marker.

26. Combined apparatus as defined by claim 19, wherein said sand blast chamber has juxtaposed doors in alignment with said means for continuously moving said marker for ingress and egress of said marker prior to and subsequent to engraving said marker.

27. Combined apparatus as defined by claim 19, including collection means to recover the spent abrasive media and waste products adjacent to said sand-blast chamber, separation means to separate said abrasive media and waste products from the blasting operation, and dual loading means for the recovered abrasive media for alternately delivering said abrasive media to said blast nozzles through dual inlet lines on a substantially continuous basis from one of said dual loading means.

28. Combined apparatus as defined by claim 27, wherein said separation means comprises one enclosed cyclone-type reclaiming chamber to both collect and separate said abrasive media and said waste products, and twin storage means to permit alternate delivery of blast media to said blast nozzles.

29. Combined apparatus as defined by claim 28, wherein the said twin storage means comprise two storage chambers for alternately depressurizing and pressurizing said storage chambers from a blast media loading mode to a blast media delivery mode to said nozzles.

30. Combined apparatus as defined in claim 19 further comprising valve means for controlling each of said nozzles individually, said programmed control means being connected to said valve means to control, with the rate of movement of said markers along said path and the rate of oscillation of said nozzles, said nozzles individually.

31. Combined apparatus as defined in claim 19 wherein said means defining said enclosed sand-blast chamber includes means defining an inlet opening and an outlet opening, said means for supporting and continuously conveying said markers extending through said inlet and outlet openings, said inlet and outlet openings each being equipped with a door adapted to open and close the respective opening, means connected to each of said doors for opening and closing said doors, said programmed control means being connected to said means for opening and closing each of said doors to permit a marker on said supporting and conveying means to pass through the respective opening and then close each of said doors to seal said chamber.

* * * * *